US011505858B2

(12) United States Patent
Sohn et al.

(10) Patent No.: US 11,505,858 B2
(45) Date of Patent: Nov. 22, 2022

(54) ALLOY-PLATED STEEL MATERIAL HAVING EXCELLENT CRACK RESISTANCE, AND METHOD FOR MANUFACTURING SAME

(71) Applicant: POSCO, Pohang-si (KR)

(72) Inventors: Il-Ryoung Sohn, Gwangyang-si (KR); Tae-Chul Kim, Gwangyang-si (KR); Jong-Sang Kim, Gwangyang-si (KR)

(73) Assignee: POSCO

( * ) Notice: Subject to any disclaimer, the term of this patent is extended or adjusted under 35 U.S.C. 154(b) by 509 days.

(21) Appl. No.: 16/471,311

(22) PCT Filed: Dec. 21, 2017

(86) PCT No.: PCT/KR2017/015276
§ 371 (c)(1),
(2) Date: Jun. 19, 2019

(87) PCT Pub. No.: WO2018/117702
PCT Pub. Date: Jun. 28, 2018

(65) Prior Publication Data

US 2020/0017947 A1 Jan. 16, 2020

(30) Foreign Application Priority Data

Dec. 22, 2016 (KR) ..... 10-2016-0177200

(51) Int. Cl.
*C23C 2/06* (2006.01)
*C22C 18/04* (2006.01)
*C23C 2/26* (2006.01)

(52) U.S. Cl.
CPC ..... *C23C 2/06* (2013.01); *C22C 18/04* (2013.01); *C23C 2/26* (2013.01)

(58) Field of Classification Search
None
See application file for complete search history.

(56) References Cited

U.S. PATENT DOCUMENTS

| | | | |
|---|---|---|---|
| 2009/0297881 | A1 | 12/2009 | Maalman et al. |
| 2010/0139816 | A1 | 6/2010 | Hanlon et al. |
| 2012/0107636 | A1 | 5/2012 | Diez et al. |
| 2015/0072166 | A1 | 3/2015 | Nakano et al. |
| 2015/0159253 | A1 | 6/2015 | Oh et al. |
| 2019/0100831 | A1 | 4/2019 | Oh et al. |

FOREIGN PATENT DOCUMENTS

| | | |
|---|---|---|
| JP | H03100155 | 4/1991 |
| JP | 2002285311 | 10/2002 |
| JP | 2002332555 | 11/2002 |

(Continued)

OTHER PUBLICATIONS

European Search Report—European Application No. 17884745.5, dated Nov. 27, 2019, citing WO 2006/002843 and WO 2018/015505.

(Continued)

*Primary Examiner* — Brian D Walck
(74) *Attorney, Agent, or Firm* — Cantor Colburn LLP

(57) ABSTRACT

Provided is a Zn—Al—Mg-based alloy-plated steel material that can be used in automobiles and home appliances and the like and, more particularly, to a Zn—Al—Mg-based alloy-plated steel material that can suppress the generation of cracks in a plating layer that are generated during processing.

4 Claims, 3 Drawing Sheets

(56) References Cited

FOREIGN PATENT DOCUMENTS

| | | |
|---|---|---|
| JP | 2006009100 | 1/2006 |
| JP | 2008504440 | 2/2008 |
| JP | 2013241665 | 12/2013 |
| JP | 2015531817 | 11/2015 |
| JP | 2018507321 | 3/2018 |
| JP | 2019528374 | 10/2019 |
| KR | 20070029267 | 3/2007 |
| KR | 20090122346 | 11/2009 |
| KR | 20140051669 | 5/2014 |
| KR | 20140081623 | 7/2014 |
| KR | 20150052376 | 5/2015 |
| KR | 20150073035 | 6/2015 |
| KR | 20150073315 | 7/2015 |
| KR | 20150075650 | 7/2015 |
| KR | 101568548 | 11/2015 |
| KR | 20160037867 | 4/2016 |
| KR | 20160078670 | 7/2016 |
| KR | 101665883 | 10/2016 |
| WO | 2010130890 | 11/2010 |
| WO | 2018015505 | 1/2018 |

OTHER PUBLICATIONS

Japanese Office Action—Japanese Application No. 2019-533319 dated May 25, 2021, citing KR 10-2016-0037867, JP H03-100155, JP 2006-009100, Oh, et al., JP 2008-504440, JP 2019-528374, KR 10-1568548, KR 10-2015-0075650, JP 2018-507321, JP 2002-285311, US 2015/0159253, JP 2013-241665, and KR 10-2015-0073315.

Oh, et al., Surface and Cut-edge Corrosion Behavior of Zn—Mg—Al Alloy-Coated Steel Sheets as a Function of the Alloy Coating Microstructure, Met. Mater. Int., Jan. 2016, vol. 22, No. 1, pp. 26-33.

International Search Report—PCT/KR2017/015276 dated Mar. 21, 2018.

Japanese Office Action—Japanese Application No. 2019-533319 dated Sep. 15, 2020, citing KR 10-2016-0037867, JP H03-100155, JP 2006-009100, JP 2008-504440, JP 2019-528374, KR 10-1568548, KR 10-2015-0075650, JP 2018-507321, JP 2002-285311, US 2015/0159253, JP 2013-241665, and KR 10-2015-0073315.

ALLOY-PLATED STEEL MATERIAL HAVING EXCELLENT CRACK RESISTANCE, AND METHOD FOR MANUFACTURING SAME

TECHNICAL FIELD

The present disclosure relates to a Zn—Al—Mg-based alloy-plated steel material which may be used in vehicles, home appliances, and the like, and more particularly, a Zn—Al—Mg-based alloy-plated steel material which may prevent the creation of cracks in a plating layer, occurring during processing.

BACKGROUND ART

As a zinc plating method which may prevent corrosion of iron through a cathodic protection method has excellent method performance and is highly economical, the method has been widely used for manufacturing a steel material having high corrosion resistance properties. Particularly, in the case of a hot-dip galvanized steel material in which a plating layer is formed by submerging a steel material in melted zinc, a manufacturing method may be simplified as compared to an electrical zinc plated steel material, and a price of a hot-dip galvanized steel material may be low, such that the consumption of a hot-dip galvanized steel material has increased in overall industrial fields of vehicles, electronic appliances, construction materials, and the like.

A hot-dip galvanized steel material, plated with zinc, may have sacrificial corrosion protection properties such that, when a hot-dip galvanized steel material is exposed to a corrosion environment, zinc having redox dislocation lower than redox dislocation of iron may be corroded first, and corrosion of a steel material may be prevented. Also, a hot-dip galvanized steel material may form a dense corrosion product on a surface of a hot-dip galvanized steel material as zinc of a plating layer is oxidized, and the steel material may be protected from an oxidization atmosphere such that corrosion resistance of the steel material may improve.

However, air pollution has increased and a corrosion environment has been increasingly deteriorated, due to high industrialization, and the demand for developing a steel material having more improved corrosion resistance than that of a conventional hot-dip galvanized steel material has increased due to strict regulations on conserving resources and energy.

Accordingly, various studies into a technique of manufacturing a zinc alloy plated steel material which may improve corrosion resistance of a steel material by adding elements such as aluminum (Al), magnesium (Mg), and the like, to a zinc plating bath, have been conducted. As an example, reference 1 discloses a technique of manufacturing a Zn—Al—Mg-based alloy-plated steel material in which Mg is additionally added to a Zn—Al plating composition system.

A general zinc plating is solidified to a Zn single phase, whereas in a zinc alloy plated steel material including Al and Mg, a Zn phase, an Mg—Zn alloy phase, an Al phase, and the like may coexist, and a difference in hardness between the phases may be great, and ionization tendencies of the phases in a corrosion environment are different from each other. Accordingly, a ratio and a combination among the phases may greatly affect mechanical and chemical properties of a plating layer.

In the case of a Zn phase, a micro-hardness may be Hv80 to 130, whereas $MgZn_2$, $Mg_2Zn_{11}$, and the like, an Mg—Zn phase, may have hardness of Hv250 to 300. Thus, when stress occurs in a plating layer, breakage may occur on a phase boundary between a Zn phase and an Mg—Zn phase. Particularly, the more coarse the Zn phase and the Mg—Zn phase, such breakage may more easily occur, and broken cracks may also become coarse.

(Reference 1) Korean Laid-Open Patent Publication No. 10-2014-0051669

DISCLOSURE

Technical Problem

An aspect of the present disclosure is to provide a Zn—Al—Mg-based alloy-plated steel material which may reduce the creation of cracking in a plating layer during processing and may have improved surface properties, and a method of manufacturing the same.

The problems which the present discourse aims to address are not limited to the above-mentioned problems, and other unmentioned problems may be explicitly understood by a person having ordinary skill in the art, based on the descriptions below.

Technical Solution

According to an aspect of the present disclosure, an alloy plated steel material having excellent crack resistance is provided, the alloy plated steel material including a base iron, and an alloy plated layer formed on at least one surface of the base iron, the alloy plated layer comprises, by weight %, 0.5 to 2.5% of Mg, 0.5 to 3.0% of Al, and a balance of Zn and other inevitable impurities, and the alloy plated layer comprises a Zn single phase and a Zn and Mg mixed phase, and in the Zn and Mg mixed phase, an Zn phase and an Mg—Zn alloy phase have a lamella structure, and an average width of the lamella structure is 1.5 μm or less.

According to an aspect of the present disclosure, a method of manufacturing an alloy plated steel material having excellent crack resistance is provided, the method including preparing a zinc alloy plating bath comprising, by weight %, 0.5 to 2.5% of Mg, 0.5 to 3.0% of Al, and a balance of Zn and other inevitable impurities; performing a plating process by submerging a base iron in the zinc alloy plating bath; and extracting a steel material from the zinc alloy plating bath and cooling the steel material until a temperature of a central portion of the steel material reaches 435° C. or lower, and a temperature difference between the central portion and an edge portion of the steel material after the cooling is 25° C. or lower.

Advantageous Effects

According to an aspect of the present disclosure, a high corrosion resistance zinc based alloy plated steel material of which a plating layer may have improved process crack resistance may be provided.

BEST MODE FOR INVENTION

Figure 1:
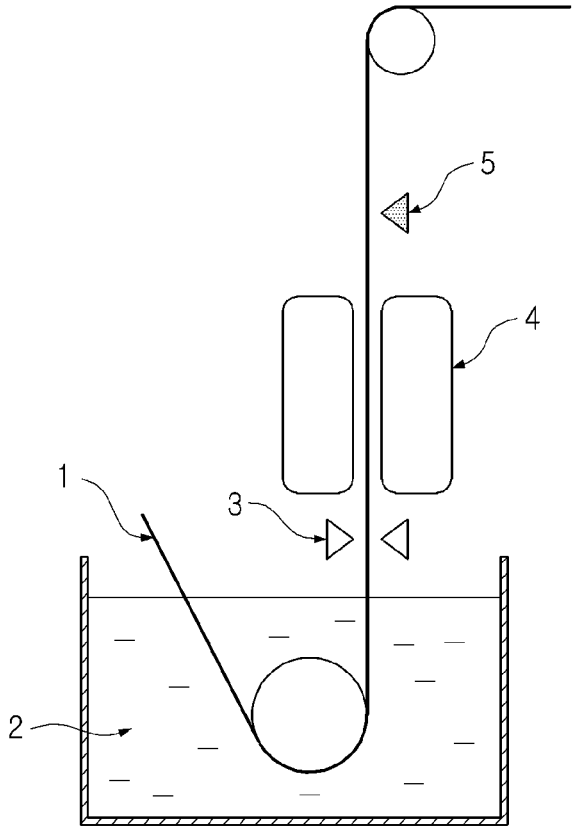
FIG. 1 is a diagram illustrating an example of a process of manufacturing an alloy plated steel material.

In the description below, the present disclosure will be described in detail.

The present disclosure relates to an alloy plated steel material including a base iron and a Zn—Al—Mg-based alloy-plated layer formed on the base iron. The inventors of the present disclosure have found that the formation and the coarsening of a phase on a Zn—Al—Mg-based alloy-plated layer deeply relates to a process of cooling a plating layer after hot-dip plating, and have found that, by controlling a structure of a plating layer and refinement thereof, the creation of cracking in a plating layer may be reduced when stress such as processing occurs.

Particularly, the formation of the phase may be closely related to a cooling process after plating, and when a cooling speed is not uniform along with a width of a steel sheet, unevenness of a structure may be caused in each portion such that corrosion resistance may degrade, and the present disclosure is suggested.

In the present disclosure, the base iron may be a steel sheet or a steel wire rod, and the steel sheet may be a hot-rolled steel sheet, a cold-rolled steel sheet, and the like, and may not be particularly limited as long as a steel sheet is able to be used in the technical field of the present disclosure.

The zinc alloy plated layer may be formed on a surface of a base iron, and may prevent the corrosion of a base iron under a corrosion environment. As a composition of the zinc alloy plated layer, the zinc alloy plated layer may include, by weight %, 0.5 to 2.5% of magnesium (Mg), 0.5 to 3.0% of aluminum (Al), and a balance of zinc (Zn) and other inevitable impurities preferably.

Mg may be very important for improving corrosion resistance of a zinc-based alloy plated steel material, and may effectively prevent corrosion of the alloy plated steel material by forming dense zinc-hydroxide based corrosion products on a surface of a plating layer under a corrosion environment. In the present disclosure, to secure sufficient corrosion resistance, 0.5 wt % of higher of Mg may be included, and it may be more preferable to include 0.8 wt % or higher of Mg. When a content of Mg is excessive, Mg oxidized dross may rapidly increase on a surface of a plating bath such that an effect of preventing oxidation by adding a small amount of element may be offset. To prevent this, 2.5 wt % or lower of Mg may be included, and it may be more preferable to control the content to be 2.0 wt % or lower.

Al may prevent the formation of Mg oxide dross in a plating bath, and may react with Zn and Mg in the plating bath and may form a Zn—Al—Mg based intermetallic compound, thereby improving corrosion resistance of a plating steel material. To this end, 0.5 wt % or higher of Al may be included, and it may be more preferable to include 0.8 wt % or higher of Al. When a content of Al is excessive, weldability and phosphate processing properties of a plating steel material may be deteriorated. To prevent this, 3.0 wt % or less of Al may be included, and it may be preferable to include 2.5 wt % or less of Al.

Figure 2:
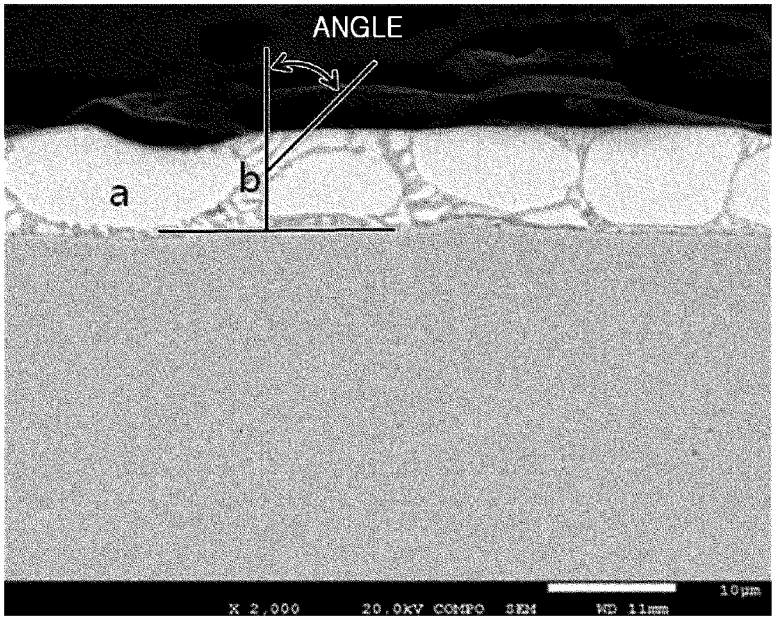
FIG. 2 is an image of a cross-sectional surface of a plating layer of inventive example 4 among embodiments.

The zinc alloy plated layer may include a Zn phase, a Zn and Mg mixed phase, and the like. FIG. 2 illustrates an example of a zinc alloy plated layer according to the present disclosure among embodiments described below. As illustrated in FIG. 2, the zinc alloy plated layer formed on the base iron may include a Zn phase (a in FIG. 2), and a Zn and Mg mixed phase (b in FIG. 2). The Zn and Mg mixed phase (b) is a phase in which a Zn phase, an Mg—Zn alloy phase, and a partial Al phase are mixed, and may form a lamellar structure in a length direction. Meanwhile, a mixed dot phase, and the like, not a linear phase, may also be observed in some portions, and in this case, a Zn phase, an alloy phase, an Al phase, and the like, are observed at the same time. The Mg—Zn alloy phase may include $MgZn_2$ as a representative phase.

In other words, in the zinc alloy plated layer, a Zn and Mg mixed phase may include a lamellar structure in which a Zn phase and an Mg—Zn alloy phase are mixed. An average width of a Zn phase in the lamella structure may be 1.5 μm or less.

Hardness of a Zn phase of the zinc alloy plated layer may be around Hv 80 to 130, and an Mg—Zn alloy phase (e.g., an $MgZn_2$ phase) may have relatively high hardness, about Hv 250 to 300. When stress occurs in the plating layer, cracks and breakage may easily occur on an $MgZn_2$ phase or along a boundary between a Zn phase and an $MgZn_2$ phase. Particularly, when a coarse lamellar is formed, the plating layer may be more vulnerable to such breakage.

Also, as illustrated in FIG. 2, a length direction of the lamellar structure may be formed at an angle of 45° or greater in a direction perpendicular to an interfacial surface between the plating layer and the base iron preferably. When the length direction of the lamellar structure is formed at an angle less than 45°, creation, propagation, and transmission of cracks may easily occur. Thus, to prevent the creation and propagation of cracks, an angle of 45° or higher may be preferable. Preferably, in an area fraction, when 30 to 100% of the lamellar structure is formed at an angle of 45° or greater in a direction perpendicular to an interfacial surface of the base iron, the propagation of cracks may be prevented.

In the present disclosure, by controlling an average width of a Zn phase in the lamellar structure to be 1.5 μm or less, cracks may be reduced on the plating layer, and even when cracks occur, a width of cracks may be significantly reduced such that breakage of the plating layer may be significantly reduced during processing.

In the present discourse, a method of manufacturing a zinc alloy plated steel material will be described in detail. In the present disclosure, the method may include preparing a zinc alloy plating bath, submerging and plating a base iron, and cooling the base iron.

A zinc alloy plating bath including, by weight %, 0.5 to 2.5% of Mg, 0.5 to 3.0% of Al, and a balance of Zn and other inevitable impurities, may be prepared. A composition of the zinc alloy plating bath may not be different from the composition of the zinc alloy plated layer described above.

Abase iron may be submerged in the prepared zinc alloy plating bath, and a steel material onto which a zinc alloy plated layer is attached may be obtained.

A temperature of the zinc alloy plating bath may be 440 to 470° C. preferably. When a temperature of the zinc alloy plating bath is less than 440° C., liquidity of the plating bath may degrade, and the amount of uniform coating may be interfered. However, when the temperature exceeds 470° C., an oxide on a surface of the plating bath may increase due to Mg oxidation in the plating bath, and rust may be created by Al and Mg of refractories in the plating bath. Thus, a preferable temperature may be 470° C. or lower, and a more preferable temperature may be 465° C. or lower.

A surface temperature of the base iron submerged in the plating bath may be higher than the temperature of the zinc alloy plating bath by 5 to 30° C. In the aspects of dissolution of a surface oxide and concentration of Al, it may be preferable to control a temperature of the base iron to be high. Particularly, to maximize the effect of the present disclosure, it may be preferable to control a surface temperature of the base iron inlet in the plating bath to be higher than a temperature of the plating bath by 5° C. or more, and it may be more preferable to control the temperature to be higher by 10° C. or more. However, when a surface temperature of the base iron inlet in the plating bath is excessively high, it may be difficult to manage a temperature of a plating pot, and an excessive amount of base iron element may be dissolved into the plating bath. Thus, it may be preferable to control a temperature of the base iron to not exceed 30° C. relative to a temperature of the plating bath, and it may be more preferable to control the temperature to not exceed 20° C.

In the plating bath, dross defects mixed as a solid phase, may be present in addition to a uniform liquid phase. Particularly, dross including an $MgZn_2$ component as a main component may be present on a surface of the plating bath in a form of floating dross, floating on a surface of the plating bath, due to Al and Mg oxides and a cooling effect. When the dross is mixed into a surface of the plating steel material, the dross may cause plating layer defects, and may affect the formation of an Al concentrated layer formed on an interfacial surface between the plating layer and the base iron. Thus, to reduce the oxide and the floating dross formed on a surface of the plating bath, it may be preferable to control an atmosphere on a surface of the plating bath to include 10 volume % or less (including 0%) of oxygen and a balance of inert gas.

Also, when a surface of the plating bath is directly exposed to external cold air, the dissolution of an intermetallic compound such as $MgZn_2$ may not easily occur. Thus, it may be necessary to control a surface of the plating bath to not be directly exposed to external cold air.

As an example embodiment to control an atmosphere on a surface of the plating bath and to prevent the contact with cold air as described above, a cover box for stabilizing air may be installed in a position in which the base iron inlet to the plating bath is externally discharged from the plating bath. The cover box may be formed on a surface of the plating bath in the position in which the base iron is externally discharged from the plating bath, and a supply pipe for supplying an inert gas may be connected to one side of the cover box. A spaced distance (d) between the base iron and the cover box may be 5 to 200 cm preferably. When the spaced distance is less than 5 cm, a plating solution may be splashed out due to instability of air caused by vibrations of the base iron and the movement of the base iron moving in a narrow space, which may cause plating defects. When the spaced distance exceeds 200 cm, there may be a difficulty in managing oxygen concentration in the cover box.

After submersing and plating the base iron, the amount of coating may be adjusted, and a cooling process may be performed. To secure an appropriate structure of the zinc alloy plated layer, a cooling process may be important. FIG. 1 is a diagram illustrating an example of a method of manufacturing a zinc alloy plated steel material. The manufacturing method of the present disclosure will be described in detail with reference to FIG. 1. A base iron (1) submerged in a plating bath (2) may be pulled, and an amount of coating may be adjusted using a coating amount control device (3). As an example, the amount of coating may be adjusted by a high pressure gas crashing onto a surface, and the high pressure gas may be air, but it may be preferable to use a gas including 90 volume % or higher of nitrogen (N2) to significantly reduce surface defects.

After adjusting the amount of coating, a cooling process may be performed using one or more of cooling means (4). One or more cooling sections may be formed by the cooling means, and a first cooling process may importantly affect surface properties of the zinc alloy plated layer, which may be related to the formation of a generation seed of a Zn phase on the surface. As a result of the research, after a steel material passes a first cooling section by a first cooling means (4), a preferable temperature of a surface of a central portion of the steel material may be 435° C. or lower. When a temperature of the surface after passing through the first cooling section is 435° C. or lower, a certain amount of Zn phase may be formed on a plated surface, which may contribute to improving corrosion resistance.

A cooling rate during the cooling may be 2 to 5° C./s preferably. When the cooling rate is too high, it may be difficult to secure the plating layer aimed in the present disclosure. When the cooling rate is too low, a speed of passing sheet may be reduced such that productivity may degrade. Thus, a preferable cooling rate may be 2 to 5° C./s.

As described above, growth of the lamellar structure of the zinc alloy plated layer may be greatly dependent on a solidification temperature and homogenization properties of a plating layer. Also, a preferable difference between a temperature of a central portion and of an edge portion of the plating steel plate may be 25° C. or lower. When the temperature difference is great, a structural difference may occur in the plating layer in the same steel material. To control the cooling of the central portion and the edge portion, an amount of a cooling gas flow of a spraying nozzle may be adjusted or an angle of the nozzle may be adjusted during the above-described cooling process.

The measurement of a temperature of the plating steel material may be conducted in a 10 to 15 m section from a molten surface using a non-contact type pyrometer. In this case, to measure a temperature taken in a width direction, the non-contact type pyrometer may need to move in a width direction to consecutively measure a temperature taken in a width direction. The pyrometer measuring a width direction may not be necessarily installed all the time during an operation, and may be removed after completing the adjustment of cooling during a cooling process.

DESCRIPTIONS OF REFERENCE NUMERALS

1 . . . BASE IRON
2 . . . PLATING BATH
3 . . . COATING AMOUNT CONTROL DEVICE
4 . . . COOLING MEANS
5 . . . TEMPERATURE MEASURING DEVICE

MODE FOR INVENTION

In the description below, an embodiment of the present disclosure will be described in detail. The below embodiment is provided for understanding of the present disclosure, and will not limit the present disclosure.

Embodiment

As indicated in Table 1 below, a cold-rolled base iron sample having a thickness of 0.7 mm was plated by being submerged in a Zn alloy plating bath containing 0.8 to 2.2% of Mg and 0.8 to 2.7% of Al, and a coating amount was adjusted to 40 $g/m^2$, an amount of single side surface plating. The coating amount was adjusted by applying pressure on the surface by spraying a gas using a gas nozzle.

A cooling process was performed, and a length of a first cooling section was 5 m. Temperatures of a central portion and of an edge portion of a plating steel material were measured using a non-contact type pyrometer (5) right after passing through the first cooling section as illustrated in FIG. 1, and the results were listed in Table 1. A position in which the pyrometer was installed was at 14 m from a molten surface.

After the plating layer is solidified, a cross-sectional surface of the manufactured zinc alloy plated steel material sample was observed, a width of a Zn phase of a lamellar structure of the plating layer was measured, corrosion resistance was tested, and the results were listed in Table 1. The sample was manufactured by cutting a 5 cm point from an edge of the steel material and a central portion, in the width direction.

The observation of the cross-sectional surface was conducted using a scanning electron microscope (SEM) in ×2,000 to ×5,000 magnification, and a structure of a random 100 μm section in the sample was examined. As for a lamellar structure of an alloy phase including a Zn phase and an $MgZn_2$ phase, a width of an Zn phase of a portion grown in a growing direction within 45° on the left and right sides with reference to a perpendicular line of an interfacial surface between the plating layer/the base iron was measured. An overage value was obtained by measuring adjacent three portions.

As for the sample manufactured in Table 1, a steel material having a thickness three times greater than a thickness of the sample was inserted in the middle, the sample was bent by 180°, and a 3T bending test was performed. A plated surface of the bent end portion was deformed the most, and a large amount of cracks of the plating layer occurred in the portion. As the plating layer on which cracks occurred was vulnerable to corrosion, a corrosion test was performed on the 3T bending test sample of each sample under an environment in which a 5% NaCl solution was consecutively sprayed, and a corrosion time in which red rust was firstly observed in the bent portion was observed. The test of whether red rust occurred was performed once a day.

As for inventive examples 1 to 6 satisfying the conditions of the present discourse, a width of an Zn phase of the lamellar structure was within 1.5 μm on average, and a red rust occurring time after the 3T bending test was 300 hours or longer, such that excellent corrosion resistance was secured.

Figure 3:
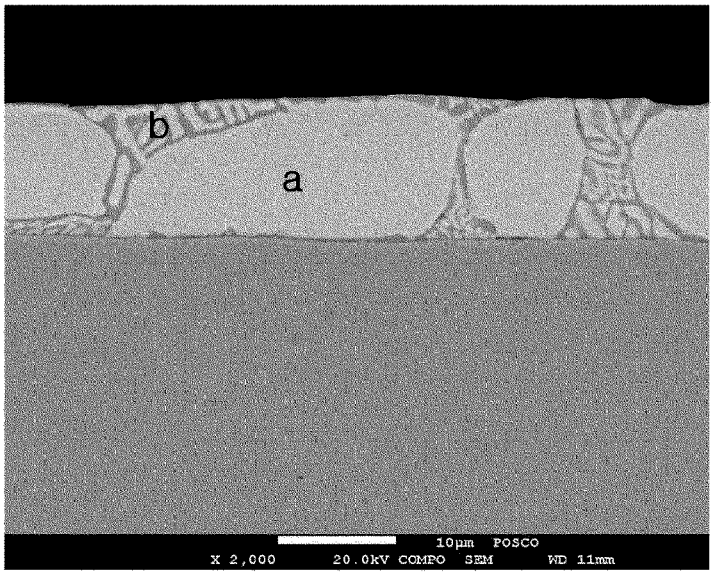
FIG. 3 is an image of a cross-sectional surface of a plating layer of comparative example 2 among embodiments.

FIG. 2 is an image obtained by observing a plating layer of inventive example 4 above, and a width of a Zn phase in the lamellar structure (b in FIG. 2) including a Zn phase and a Zn—Mg alloy phase was fine, as 1.5 μm or less. Referring to FIG. 3 illustrating comparative example 2, a width of a Zn phase of the lamellar structure (b in FIG. 3) exceeded 1.5 μm.

Comparative examples 1 to 3 did not satisfy the conditions of the present disclosure. Accordingly, a coarse internal structure was formed such that cracks were easily created, and corrosion resistance was deteriorated, as within 300 hours.

The invention claimed is:

1. An alloy plated steel material having excellent crack resistance, comprising:

a base iron, and a zinc alloy plated layer formed on at least one surface of the base iron, wherein the zinc alloy plated layer comprises, by weight %, 0.5 to 2.5% of Mg, 0.5 to 3.0% of Al, and a balance of Zn and other inevitable impurities, and wherein the zinc alloy plated layer comprises a Zn single phase and a Zn and Mg mixed phase, and in the Zn and Mg mixed phase, an Zn phase and an Mg—Zn alloy phase have a lamella structure, and an average width of the lamella structure is 1.5 μm or less.

2. The alloy plated steel material of claim 1, wherein a length direction of the lamella structure is formed at an angle of 45° or greater to a vertical direction of the base iron and the zinc alloy plated layer.

3. The alloy plated steel material of claim 2, wherein the lamella structure of which a length direction is formed at an

TABLE 1

| | Composition (weight %) | | Temperature (° C.) | | | Width of Zn Phase of Lamellar Structure (μm) | | Red Rust Occurring Time |
|---|---|---|---|---|---|---|---|---|
| Classification | Mg | Al | Central Portion | Edge Portion | Difference | Maximum | Average | (Hrs) |
| Inventive Example 1 | 0.8 | 0.8 | 417 | 431 | 14 | 1.1 | 0.8 | 312 |
| Inventive Example 2 | 1.5 | 1.5 | 415 | 428 | 13 | 1 | 0.7 | 384 |
| Inventive Example 3 | 1.5 | 1.5 | 431 | 440 | 9 | 1.3 | 0.7 | 360 |
| Inventive Example 4 | 1.4 | 1.4 | 425 | 436 | 11 | 1.2 | 1.0 | 384 |
| Inventive Example 5 | 1.6 | 1.6 | 420 | 435 | 15 | 1.2 | 0.9 | 408 |
| Inventive Example 6 | 2.0 | 2.7 | 430 | 439 | 9 | 1.4 | 1.0 | 526 |
| Comparative Example 1 | 1.4 | 1.4 | 425 | 455 | 30 | 2.0 | 1.7 | 288 |
| Comparative Example 2 | 1.4 | 1.4 | 437 | 457 | 20 | 2.2 | 1.9 | 264 |
| Comparative Example 3 | 1.6 | 1.6 | 430 | 460 | 30 | 2.5 | 2.3 | 240 |

angle of 45° or greater to a vertical direction of the base iron and the zinc alloy plated layer is 30 to 100% of an overall lamella structure.

4. The alloy plated steel material of claim 1, wherein hardness of a Zn phase of the zinc alloy plated layer is Hv 80 to 130, and hardness of an Mg—Zn alloy phase is Hv 250 to 300.

* * * * *